US009212505B2

(12) United States Patent
Geng et al.

(10) Patent No.: US 9,212,505 B2
(45) Date of Patent: Dec. 15, 2015

(54) LOCKING DEVICE

(71) Applicant: General Aerospace GmbH, Eschbach (DE)

(72) Inventors: Johannes Geng, Freiburg (DE); Erik van den Dolder, Eschbach (DE)

(73) Assignee: General Aerospace GmbH, Eschbach (DE)

( * ) Notice: Subject to any disclaimer, the term of this patent is extended or adjusted under 35 U.S.C. 154(b) by 237 days.

(21) Appl. No.: 13/786,819

(22) Filed: Mar. 6, 2013

(65) Prior Publication Data

US 2013/0247625 A1 Sep. 26, 2013

(30) Foreign Application Priority Data

Mar. 7, 2012 (DE) ..... 10 2012 004337

(51) Int. Cl.
*E05C 3/06* (2006.01)
*E05B 47/00* (2006.01)
(Continued)

(52) U.S. Cl.
CPC ..... *E05B 47/0038* (2013.01); *E05B 15/0086* (2013.01); *E05B 47/00* (2013.01); *E05B 47/0004* (2013.01); *E05B 57/00* (2013.01); *E05B 2047/0067* (2013.01); *E05B 2047/0084* (2013.01); *Y10T 70/7057* (2015.04); *Y10T 70/7062* (2015.04)

(58) Field of Classification Search
CPC ..... E05B 2047/0014; E05B 2047/0015; E05B 2047/0016; E05B 2047/0035; E05B 2047/0036; E05B 2047/0057; E05B 2047/0058; E05B 2047/0073; E05B 47/02; E05B 47/023; E05B 47/06; E05B 47/0603; E05B 81/04; E05B 81/05; E05B 81/08; E05B 81/16; E05B 81/18; E05B 81/20; E05B 83/16; E05B 83/18; E05B 83/22; E05C 3/12; E05C 3/124; E05C 3/16; E05C 3/165; E05C 3/167; E05C 3/22; E05C 3/26; E05C 3/30; E05C 3/40
USPC ..... 292/201, 216, 123, 129, 97–99, 215, 292/222–224, 196–198, 341.15–341.17, 292/DIG. 49; 244/102 SL, 118.1, 129.5, 244/118.5; 200/50.06; 70/276, 277, 281, 70/282, 278.7
See application file for complete search history.

(56) References Cited

U.S. PATENT DOCUMENTS 2,325,225 A * 7/1943 Burke ..... 292/123
3,504,406 A * 4/1970 Schott ..... 24/603
(Continued)

FOREIGN PATENT DOCUMENTS

DE 2822985 A1 11/1979
DE 102004027028 A1 12/2005
DE 202008012410 U1 2/2010

*Primary Examiner* — Alyson M Merlino
(74) *Attorney, Agent, or Firm* — The Webb Law Firm

(57) ABSTRACT

A locking device has adjustable device parts, one of which comprises a locking element and another comprises a support part. A latch can be moved between a closed and an open position. A knee lever comprises a first arm pivotable about a pivot axis and a second arm, pivotable relative to the first arm about a knee joint axis. The latch is drivably connected to the knee lever so that in the closed position, the arms are pivoted into a first pivot position located near the dead center point of the knee lever and the knee lever can be positioned against a point of abutment distanced from the pivot axis. The knee lever can be moved by an actuator connectable to an electrical energy storage unit from the first pivot position across its dead center point into a second pivot position corresponding to the open position.

8 Claims, 3 Drawing Sheets

(51) Int. Cl.

| | |
|---|---|
| ***E05B 57/00*** | (2006.01) |
| ***E05B 15/00*** | (2006.01) |
| *E05C 3/16* | (2006.01) |

(56) References Cited

U.S. PATENT DOCUMENTS

| | | | | | |
|---|---|---|---|---|---|
| 4,518,180 | A | * | 5/1985 | Kleefeldt et al. | 292/201 |
| RE34,396 | E | * | 10/1993 | Wollenhaupt | 200/50.06 |
| 5,288,037 | A | * | 2/1994 | Derrien | 244/102 SL |
| 6,705,140 | B1 | * | 3/2004 | Dimig et al. | 70/277 |
| 2002/0070564 | A1 | * | 6/2002 | Ohta et al. | 292/201 |
| 2002/0108412 | A1 | * | 8/2002 | Starken | 70/275 |
| 2003/0080569 | A1 | * | 5/2003 | Raymond et al. | 292/201 |
| 2006/0028029 | A1 | * | 2/2006 | Spurr | 292/216 |
| 2009/0284025 | A1 | * | 11/2009 | Salcombe | 292/201 |
| 2010/0327609 | A1 | * | 12/2010 | Akizuki et al. | 292/85 |
| 2011/0253714 | A1 | | 10/2011 | Ivester et al. | |
| 2011/0254705 | A1 | | 10/2011 | Hashberger et al. | |
| 2012/0167646 | A1 | * | 7/2012 | Sharma et al. | 70/280 |

* cited by examiner

1

LOCKING DEVICE

BACKGROUND OF THE INVENTION

1. Field of the Invention

The invention relates to a locking device with at least two device parts that can be adjusted relative to one another between a closed and an open position, one of which parts having a locking element and another having a support part with a latch movable in relation thereto, said latch being adjustable between a closed and an open position in such a way that it locks the locking element when in the closed position and releases the latter when in the open position.

2. Description of Prior Art

Such a device is known from actual practice. It is used in passenger planes during the flight for locking the luggage compartment hatches of the carry-on luggage compartments located above the passenger seats so that the luggage items located therein cannot fall out of the luggage compartments during, for example, turbulence and/or sudden flight maneuvers. To this end, each luggage compartment has a luggage compartment hatch that can be adjusted between a closed and an open position. On the luggage compartment hatch is arranged a support part configured as a lock case on which is mounted a latch adjustable between a closed and an open position, which operates coactively with a locking element provided on the luggage compartment. If the latch is in the closed position with the luggage compartment closed, the locking element catches behind the latch so that the luggage compartment hatch cannot open accidentally. In actual practice the locking device has been proven to be reliable because it still remains functional even with electrical system of the aircraft shut off. However, the locking system has the disadvantage of being relatively heavy. This is particularly true if the luggage compartment hatch is to be opened from a place conveniently reached by the passengers but remote from the latch by means of a suitable actuating element such as a handle and if the actuating element is mechanically coupled to the latch via a pull wire, a rod assembly, or the like.

Hence the object is to create a locking device of the aforementioned type that can be reliably and conveniently unlocked in an airplane but which is also light in weight.

SUMMARY OF THE INVENTION

According to the invention, this object is achieved wherein a knee lever is arranged on the support part, which lever has at least a first arm pivotable relative to the support part about a pivot axis and a second arm that is pivotable relative to the first arm about a knee joint axis distanced from and running parallel to the pivot axis, wherein the latch is drivably connected to the knee lever in such a way that, with the latch in the closed position, the arms of the knee lever are pivoted relative to one another into a first pivot position located near the dead center position of the knee lever and the knee lever in this pivot position is positioned against a point of abutment distanced from the pivot axis when a retention force acting on the latch via the locking element is generated, wherein the knee lever is movable by means of an unlocking mechanism from the first pivot position across its dead center to a second pivot position corresponding to the open position of the latch, and wherein the unlocking mechanism for adjusting the knee lever from the first to the second pivot position comprises an electric actuator that can be connected to an electrical energy storage unit.

In an advantageous manner it is thus possible to unlock the locking device conveniently from a place remote from the latch by means of, for example, an electric pushbutton or similar actuation mechanism. It is thus possible to dispense with a mechanical connection between the actuating element and the actuator since the unlocking is achieved by electrical means with the actuator. The locking device is thus able to be light in weight. Since the actuator is supplied with power from an electrical energy storage unit, the locking device can be actuated independently of the electrical system of the aircraft. Thus it is also possible to unlock the locking device if the power supply of the aircraft is turned off (for example, upon reaching the parking position of the aircraft). The energy storage unit is preferably disposed in close proximity to the actuator and can, for example, be arranged on or in a luggage compartment to be locked with the locking device and preferably together with the actuator and the knee lever in a support part configured as a lock case. A further advantage of the energy storage unit is that when unlocking the latch, the supply voltage of the aircraft is either not subjected or only slightly subjected to an electric current even if, for example, a plurality of locking devices in a passenger plane are simultaneously actuated. Because the latch in the locking position is held against a point of abutment by a knee lever arranged near its dead center point, the latch is securely held in the locking position even if major retention forces are generated. By means of the unlocking mechanism, however, the latch subjected to retention force can be adjusted to the open position with little effort. The actuator and the energy storage unit can thus have very compact dimensions and a correspondingly light weight.

In a preferred embodiment of the invention, the actuator comprises an electromagnet with an electromagnetically movable actuating element that can be slid transversely to the pivot axis for moving the knee lever between a neutral position and an operating position. The locking device can thus be produced economically with little weight.

In an improvement of the invention, the actuating element is configured as a striker bolt, which is distanced from an actuation point of the knee lever remote from the pivot axis by a clearance in the neutral position and positioned against the actuation site in the operating position. The striker bolt can then be accelerated into the clearance when moving from the neutral position to the operating position in order to build up the kinetic energy needed to move the latch from the closed position to the open position. The actuating element can thus exhibit a correspondingly low power consumption, whereas the latch can still be opened in a reliable manner even if it is subjected to a retention force. Owing to the low power consumption of the actuating element, the actuating element and the energy storage unit can be configured with very compact dimensions and a correspondingly light weight.

It is advantageous if the latch is configured as a hook-shaped part that is connected to the support part in such a way that it is pivotable between the closed and an open position about a rotation axis aligned roughly parallel to the pivot axis. The locking element can then be configured as a locking prominence, in particular as a bolt, behind which the hook-shaped latch catches in the locking position.

In a preferred embodiment of the invention, the latch is connected to the second arm of the knee lever in such a way that it is pivotable about a connecting joint axis aligned parallel to its rotation axis and distanced from the latter and the knee joint axis. The locking device thus enables even more compact dimensions.

It is advantageous if a spring is arranged between the support part and the knee lever, which spring exerts a spring force and/or a torque on the knee lever in such a way that the latter is pressed against the point of abutment when the latch is in the closed position. If the locking device is subjected to accelerations and/or vibrations, an accidental movement of the knee lever is thus prevented when the latter is in the first pivot position or the closed position.

In an advantageous embodiment of the invention, a spring element is arranged between the support part and the latch, which element is tensioned when the latch is moved from the open to the closed position. If the locking device is subjected to accelerations and/or vibrations, an accidental movement of the latch is thus prevented when the latter is in the open position.

It is advantageous if the actuating element comprises a permanent magnet and if the actuator is connected to a control mechanism comprising a magnetic field sensor for detecting the position of the permanent magnet and further comprising an actuating element for activating the actuator. It is even possible for the permanent magnet to be arranged on the movable actuating element of the electromagnet and to operate coactively with a field coil for generating a magnetic field. The permanent magnet thus fulfills a dual function in that it is used for driving the actuating element on the one hand and for detecting the position of the actuating element on the other.

In a preferred embodiment of the invention the energy storage unit includes at least one capacitor, which is connected to supply voltage terminals via a charging mechanism. Should the need arise, the energy storage unit can be charged from the electrical system of the aircraft. The charging current can be less than the current required to actuate the actuator, hence hardly any demand is placed on the aircraft electrical system when charging the capacitor. The capacitor can in particular be an electrochemical dual-layer capacitor.

BRIEF DESCRIPTION OF THE DRAWINGS

An example of embodiment of the invention is explained in more detail the following, with reference to the drawing. Shown are.

DETAILED DESCRIPTION OF THE PREFERRED EMBODIMENTS

Figure 1:
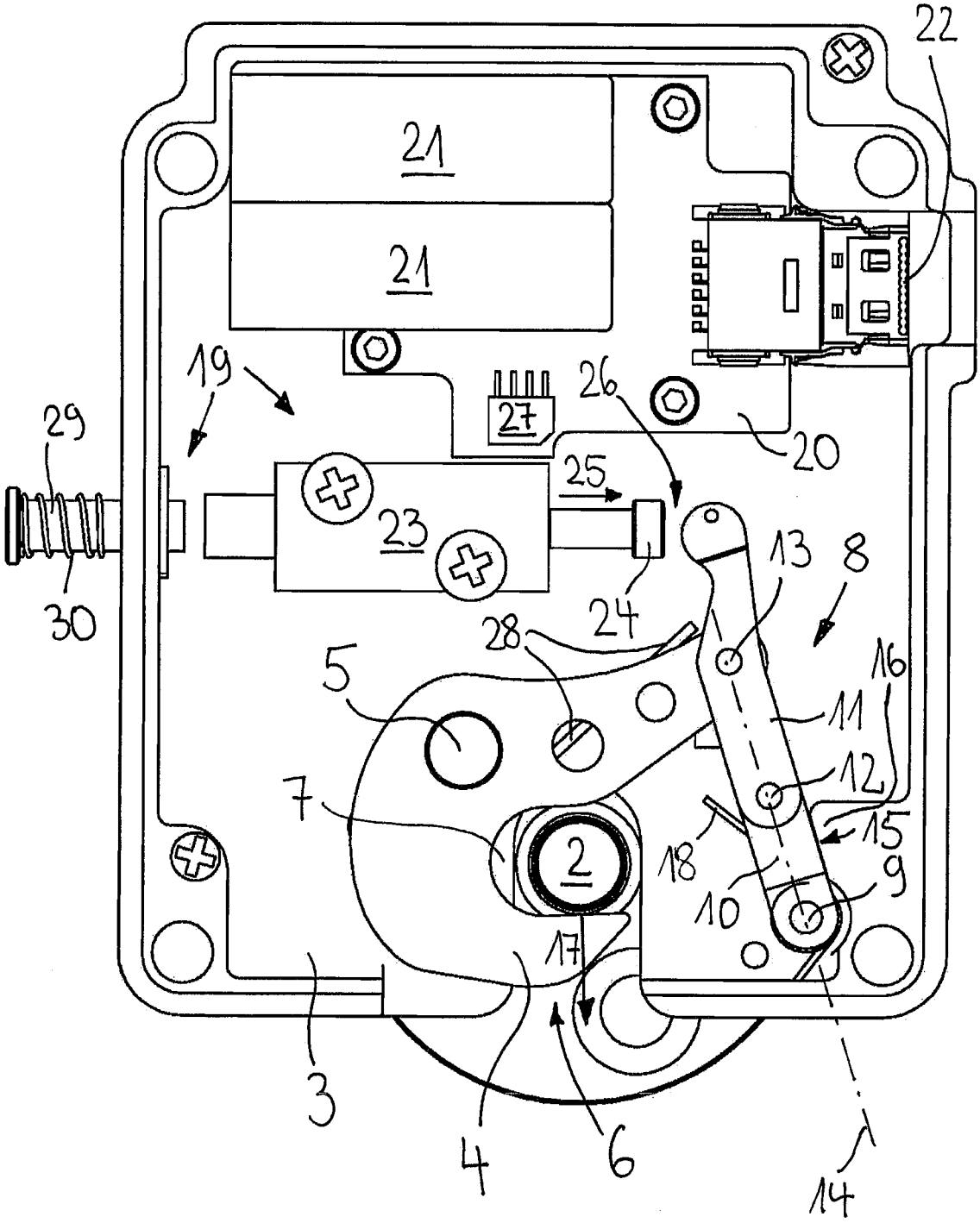
FIG. 1 a top view of a locking device in the closed position.

A locking device for locking a luggage compartment in a passenger section of an airplane designated in its entirety by 1 in FIG. 1 has a luggage bin not shown in any greater detail in the drawing, which is arranged in the ceiling area of the passenger section above the seats of the passengers. For holding carry-on luggage or similar objects, the luggage bin has an inner cavity delimited by walls arranged behind an opening. On the opening is arranged a luggage compartment cover (not shown in any greater detail in the drawing), which is movable in a manner known per se between an open position, in which the inner cavity can be accessed via the opening for stowing and removing luggage items, and a closed position, in which the luggage compartment cover covers the opening. The luggage compartment cover is preferably configured as a luggage compartment hatch but can also be a sliding door.

Figure 3:
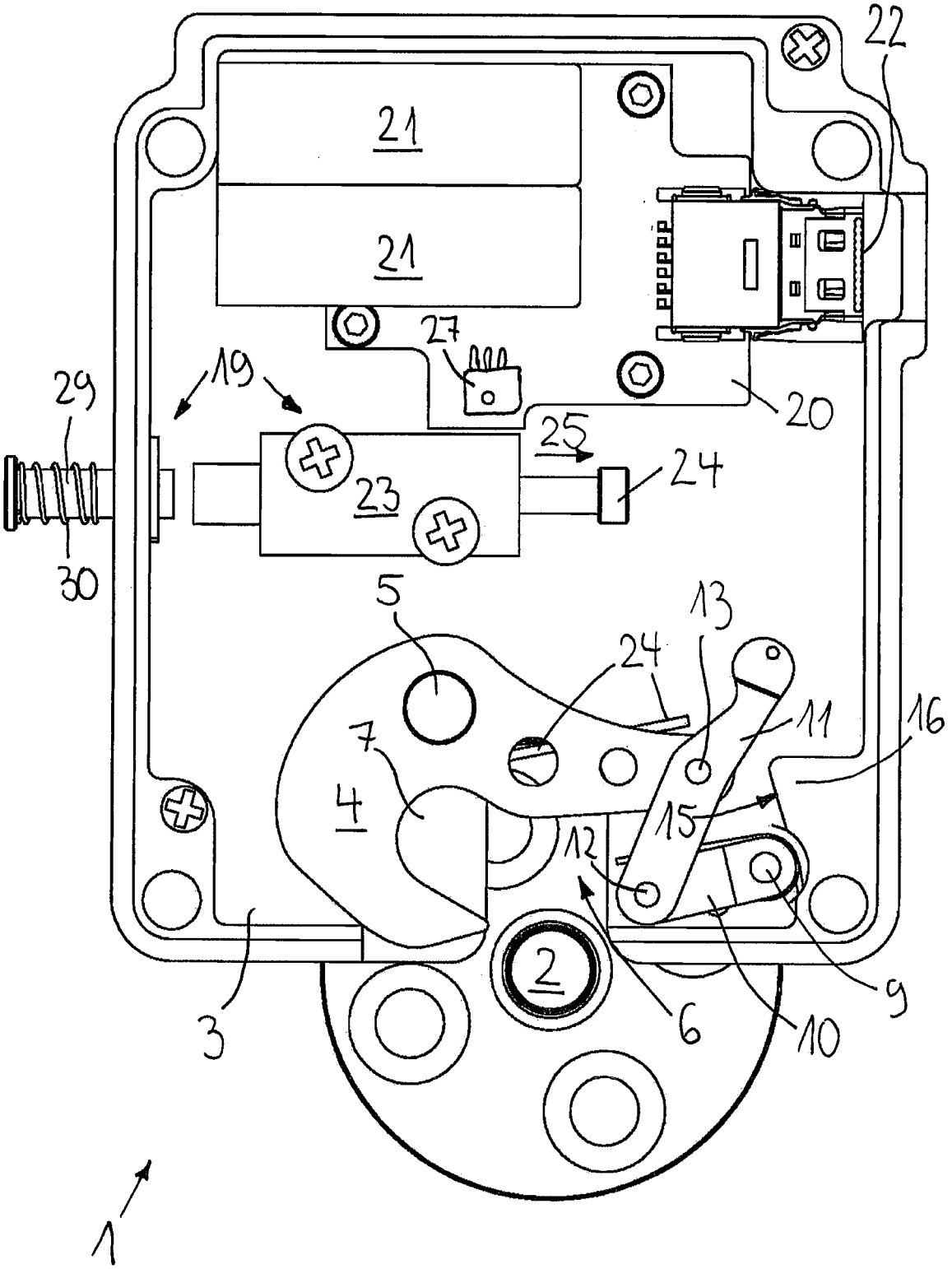

On the luggage bin is arranged a roughly bolt-shaped locking element 2 and on the luggage compartment cover is arranged a support part 3 configured as a lock case, relative to which a movable latch 4 can be moved between a closed position shown in FIG. 1 and an open position shown in FIG. 3. The latch 4 is configured as a hook-shaped part that is connected to the support part 3 in such a way that it is pivotable relative to the latter about a rotation axis 5 aligned normal to the plane of FIG. 1.

The support part 3 has a roughly slot-shaped recess 6 open at the edge on one end and extending in a plane aligned normal to the rotation axis 5 of the latch 4. In the closed position of the luggage compartment cover, the locking element 2 engages in the recess 6.

The latch 4 has a roughly U-shaped opening 7 that overlaps the recess when the latch 4 is in the closed position. The latch 4 on the one hand and the recess 6 on the other each engage around the locking element 2 in directions running transversely to one another on both sides in such a way that the locking element 2 is enclosed in a positive locking manner by the support part 3 and the latch 4.

On the support part 3 is arranged a knee lever 8 comprising a first arm 10 pivotable relative to the support part 3 about a pivot axis 9 and further comprising a second arm 11, which is connected to the first arm 10 in such a way that it is pivotable about a knee joint axis 12 distanced from the pivot axis 9 and running parallel to the pivot axis 9.

The latch 4 is pivotably connected to the second arm 11 at a connecting joint axis 13 distanced from its rotation axis 5 and the knee joint axis 12 of the knee lever 8 and parallel to the knee joint axis 12. As can be discerned in FIG. 1, in the closed position of the latch 4 the arms 10, 11 of the knee lever 8 are arranged relative to one another in a first pivot position near the dead center point of the knee lever 8. The knee joint axis 12 is spaced somewhat away from the locking element 2 by a plane 14 containing the pivot axis 9 and the connecting joint axis 13.

In this position, the first arm 10 is positioned against a point of abutment 15, which is located on a stop element 16 arranged on the support part 3. The point of abutment 15 is arranged on the side of the knee lever 8 facing away from the locking element 2 in such a way that the first arm 10 rests on the point of abutment 15 if the locking element 2 is subjected to a retention force 17 directed away from the bottom of the recess 6 towards the point of the recess 6 that is open at the edge. The latch 4 is thus prevented from pivoting about its rotation axis 5 towards the open position.

To prevent an unintentional movement of the knee lever 8 out of the first pivot position, a spring 18 configured as a torsion spring is arranged between the first arm 10 and the support part 3, which pre-tensions the first arm 10 towards the point of abutment 15.

Figure 2:
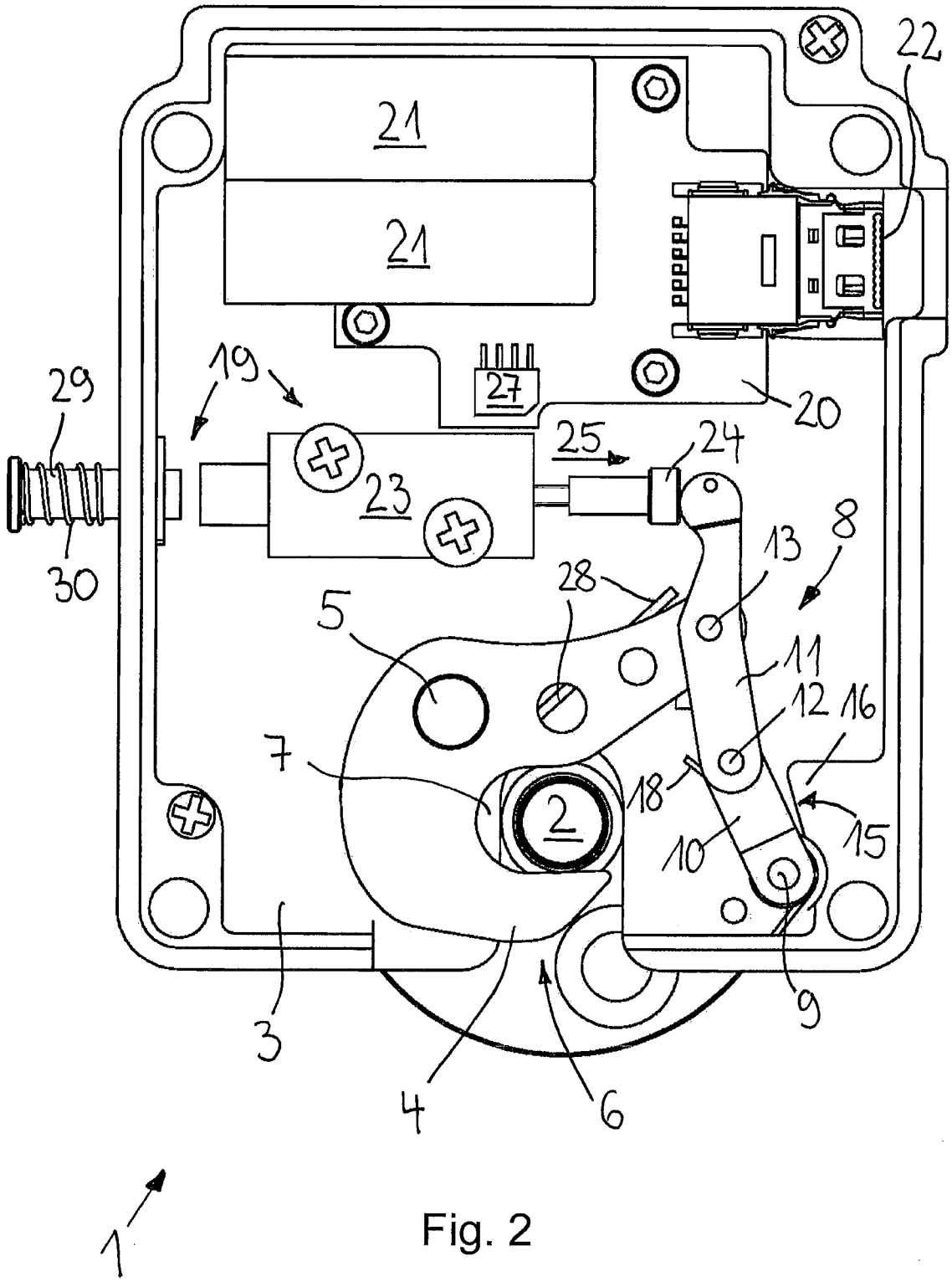
FIG. 2 a top view of the locking device during the unlocking of a latch hook, and FIG. 3 a representation similar to FIG. 1 and FIG. 2, but with the locking device in the open position.

For unlocking the latch 4, the locking device 1 comprises an unlocking mechanism designated in its entirety by 19 by which the latch 4 is movable from its first pivot position corresponding to the closed position across its dead center point to a second pivot position corresponding to the open position of the latch 4 illustrated in FIG. 3. As can be discerned in FIGS. 2 and 3, the knee joint axis 12 moves towards the recess 6 of the support part 3.

The unlocking mechanism 19 has an electric actuator that can be connected via a control mechanism 20 arranged on the support part 2 to an electrical energy storage unit 21 in order to unlock the latch 4. The electrical energy storage unit 21 has at least one power capacitor (Powercap) arranged on the support part 2. The electrical energy storage unit 21 can be charged from the electrical system of the aircraft via an electrical connection 22 arranged on the support part 2. The actuator can be actuated with a pushbutton (not shown in any greater detail in the drawing) capable of connecting to the electrical connection 22 and arranged remote from the latch 4.

The actuator comprises an electromagnet, which has a solenoid 23 arranged on the support part 3 that can be supplied with power via the control mechanism 20. An actuating element 24 slidably mounted relative to the support part 3 and configured as a striker bolt operates coactively with the solenoid 23, which element comprises a permanent magnet (not shown in any greater detail in the drawing) capable of sliding transversely to the pivot axis 9 of the latch 4 in the direction of the arrow 25, counter to the reset force of a spring, from a neutral position shown in FIG. 1 to an operating position shown in FIG. 2 when the solenoid 23 is supplied with power.

In the neutral position the actuating element 24 is distanced from the knee lever 8 by a clearance 26, and in the operating position the actuating element 24 is positioned against the second arm 11 at a point of actuation distanced from the axis of the connecting joint 12. On its course from the neutral position to the operating position, the actuating element 24 is accelerated into the clearance 26. The kinetic energy thus built up is transferred in the form of a torque to the second arm 11 when the actuating element 24 collides with the latter. The torque is oriented and dimensioned in such a way that the first arm 10 is moved from the first pivot position into the second pivot position, counter to the spring force of the first torsion spring 18. The latch 4 pivots about its rotation axis 5 so that the locking element 2 is released and can be moved out of the recess 6 (FIG. 3).

For detecting the position of the actuating element 24, the control mechanism 20 has a magnetic field sensor 27 arranged stationarily on the support part 3 with which the magnetic field of the permanent magnet can be detected.

An elastic element 28 configured as a torsion spring is arranged between the support part 3 and the latch 4, which element exerts a torque acting on the latch 4 towards the open position thereof. This prevents the latch from accidentally moving out of the open position while the luggage compartment cover is open. The elastic element 28 is tensioned when the latch 4 is moved from the open position to the closed position. The elastic element 28 is dimensioned such that in the open position, it exerts a torque on the first arm 10 of the knee lever 8 that is directed counter to and which is greater in value than the torque induced by the spring 18.

It should be noted that the latch 4 can also be unlatched manually if need be. To this end, an axially slidable pushbutton 29 is mounted on the support part 3, which can be positioned counter to the reset force of a coil spring 30 against the actuating element 24 in such a way that the latter is moved into the operating position.

The invention claimed is:

1. A locking device with two device parts movable relative to one another between a closed and an open position, one of which comprises a locking element and another of which comprises a support part with a latch movable relative thereto, between a closed position and an open position in such a way that it engages with the locking element in the closed position and releases from the locking element in the open position, wherein on the support part is arranged a knee lever comprising a first arm pivotable relative to the support part about a pivot axis and further comprising a second arm, which is pivotable relative to the first arm about a knee joint axis distanced from the pivot axis and running parallel to the pivot axis, wherein the latch is drivably connected to the knee lever in such a way that, when the latch is moved to its closed position, the arms of the knee lever are pivoted relative to one another into a first pivot position located near a dead center point of the knee lever, wherein, when in the first pivot position, the knee lever is positioned against a point of abutment distanced from the pivot axis when a retention force acting on the latch via the locking element is generated, wherein the knee lever is movable by means of an unlocking mechanism from the first pivot position across its dead center point to a second pivot position corresponding to the open position of the latch, and wherein the unlocking mechanism for moving the knee lever from the first pivot position to the second pivot position comprises an electric actuator that can be connected to an electrical energy storage unit, wherein the actuator comprises an electromagnet with an electromagnetically movable actuating element for moving the knee lever from the first pivot position to the second pivot position, wherein the movable actuating element can be slid transversely relative to the pivot axis of the knee lever between a neutral position and an operating position, wherein the latch is configured as a hook-shaped part that is connected to the support part in such a way that it is pivotable between its closed and open positions about a rotation axis aligned roughly parallel to the pivot axis, wherein the actuating element is configured as a striker bolt that cooperates with an actuation point of the knee lever remote from the pivot axis, wherein the striker bolt is distanced from the actuation point by a clearance in the neutral position such that there is no contact between the striker bolt and the actuation point in the neutral position and wherein the striker bolt is positioned against the actuation point in the operating position, and wherein the clearance is present when the latch is in its closed position.

2. The locking device as in claim 1, wherein the latch is connected to the second arm of the knee lever in such a way that it is pivotable about a connecting joint axis aligned parallel to the rotation axis and distanced from the rotation axis and the knee joint axis.

3. The locking device as in claim 1, wherein the locking element is configured in the form of a bolt, and wherein the latch comprises a roughly U-shaped opening compatible with the locking element, in which the locking element engages when the latch is in its closed position.

4. The locking device as in claim 1, wherein a spring is arranged between the support part and the knee lever, which subjects the knee lever to a spring force and/or to a torque in such a way that the knee lever is pressed against the point of abutment when the latch is in its closed position.

5. The locking device as in claim 1, wherein an elastic element is arranged between the support part and the latch, which is tensioned as the latch is moved from its open position into its closed position.

6. The locking device as in claim 1, wherein the actuating element comprises a permanent magnet, and wherein the actuator is connected to a control mechanism comprising a magnetic field sensor for detecting the position of the permanent magnet and further comprising an activation element for activating the actuator.

7. The locking device as in claim 1, wherein the energy storage unit includes at least one capacitor that is connected via a charging mechanism to supply voltage connections.

8. A locking device with two device parts movable relative to one another between a closed and an open position, one of which comprises a locking element and another of which comprises a support part with a latch movable relative thereto, between a closed position and an open position in such a way that it engages with the locking element in the closed position and releases from the locking element in the open position, wherein on the support part is arranged a knee lever comprising a first arm pivotable relative to the support part about a pivot axis and further comprising a second arm, which is pivotable relative to the first arm about a knee joint axis distanced from the pivot axis and running parallel to the pivot axis, wherein the latch is drivably connected to the knee lever in such a way that, when the latch is moved to its closed position, the arms of the knee lever are pivoted relative to one another into a first pivot position located near a dead center point of the knee lever, wherein, when in the first pivot position, the knee lever is positioned against a point of abutment distanced from the pivot axis when a retention force acting on the latch via the locking element is generated, wherein the knee lever is movable by means of an unlocking mechanism from the first pivot position across its dead center point to a second pivot position corresponding to the open position of the latch, and wherein the unlocking mechanism for moving the knee lever from the first pivot position to the second pivot position comprises an electric actuator that can be connected to an electrical energy storage unit, wherein the actuator comprises an electromagnet with an electromagnetically movable actuating element for moving the knee lever from the first pivot position to the second pivot position, wherein the movable actuating element can be slid transversely relative to the pivot axis of the knee lever between a neutral position and an operating position, wherein the latch is configured as a hook-shaped part that is connected to the support part in such a way that it is pivotable between its closed and open positions about a rotation axis aligned roughly parallel to the pivot axis, wherein the actuating element is configured as a striker bolt that cooperates with an actuation point of the knee lever remote from the pivot axis, wherein the striker bolt is distanced from the actuation point by a clearance in the neutral position such that the striker bolt, being in the neutral position, can be moved towards the actuation point while the knee lever remains in the first position without being move, and is then positioned against the actuation point in the operating position, and wherein the clearance is present when the latch is in its closed position.

* * * * *